US012325940B2

(12) United States Patent
Haug et al.

(10) Patent No.: US 12,325,940 B2
(45) Date of Patent: Jun. 10, 2025

(54) SEWING MACHINE NEEDLE HAVING A RECESS

(71) Applicant: Groz-Beckert KG, Albstadt (DE)

(72) Inventors: Kai-Uwe Haug, Nusplingen (DE); Bernd Eugen Hillenbrand, Albstadt (DE); Florian Perotti, Veringenstadt (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 18/265,853

(22) PCT Filed: Nov. 17, 2021

(86) PCT No.: PCT/EP2021/081981
§ 371 (c)(1),
(2) Date: Jun. 7, 2023

(87) PCT Pub. No.: WO2022/128295
PCT Pub. Date: Jun. 23, 2022

(65) Prior Publication Data

US 2024/0026587 A1 Jan. 25, 2024

(30) Foreign Application Priority Data

Dec. 16, 2020 (EP) ..... 20214663

(51) Int. Cl.
*D05B 85/00* (2006.01)
*B21G 1/04* (2006.01)

(52) U.S. Cl.
CPC ..... *D05B 85/00* (2013.01); *B21G 1/04* (2013.01)

(58) Field of Classification Search
CPC ..... D05B 85/00; D05B 85/05; D05B 65/00; D05B 85/02; D05C 15/20
See application file for complete search history.

(56) References Cited

U.S. PATENT DOCUMENTS

2006/0112867 A1 6/2006 Weinberg et al.

FOREIGN PATENT DOCUMENTS

| | | | |
|---|---|---|---|
| CN | 1487136 | A | 4/2004 |
| CN | 2663477 | Y | 12/2004 |
| CN | 105899721 | A | 8/2016 |
| DE | 962949 | C | 5/1957 |
| DE | 3149383 | A1 | 11/1982 |

(Continued)

OTHER PUBLICATIONS

Translation of EP2896732A1, 2015 (Year: 2015).*

(Continued)

*Primary Examiner* — Khoa D Huynh
*Assistant Examiner* — Erick I Lopez
(74) *Attorney, Agent, or Firm* — Fitch, Even, Tabin & Flannery LLP

(57) ABSTRACT

A sewing machine needle (1) is described, which reduces the friction between the blade (2) of the sewing machine needle (1) and the fabric and which can be manufactured economically in large numbers. The sewing machine needle (1) includes a needle eye (3) and at least one recess (5), wherein the distance between an upper edge (6) of the recess (5) and the lateral position of the axis (12) of the needle eye (3) differs from the distance between a lower edge (7) of the recess (5) and the lateral position of the axis (12) of the needle eye (3).

15 Claims, 9 Drawing Sheets

(56) References Cited

FOREIGN PATENT DOCUMENTS

| | | | | |
|---|---|---|---|---|
| EP | 1391548 | A1 * | 2/2004 | ..... D05B 85/00 |
| EP | 2896732 | A1 * | 7/2015 | ..... D05B 85/00 |
| TW | 201727001 | A | 8/2017 | |

OTHER PUBLICATIONS

Algerian National Institute of Industrial Property; Notification of Examination Result in corresponding Algerian Patent Application No. DZ/P/2023/001179, dated Nov. 27, 2023; 2 pages.

European Patent Office; European Office action in corresponding European Patent Application No. 20214663.5; dated Jun. 7, 2022; 12 pages.

European Patent Office; European Search Report for European Patent Application No. 20214663.5 dated May 18, 2021; 17 pages.

Government of Pakistan, Intellectual Property Organization, The Patent Office; Examination Report in corresponding Application No. 915/2021, dated Jul. 14, 2022; 2 pages.

International Search Report and Written Notice for PCT/EP2021/081981, dated Jan. 31, 2021; 28 pages.

European Patent Office; International Search Report for PCT/EP2021/081981 mailed Jan. 31, 2022; 2 pages.

Government of the People's Republic of Bangladesh, Department of Patents, Industrial Designs & Trademarks, Ministry of Industries; Office Action in corresponding Bangladesh Patent Application No. 427/2021/184, dated Aug. 27, 2024. 1 page.

Egyptian Patent Office; Office Action in corresponding Egyptian Patent Application No. 00552/2023/EG/P, dated Dec. 29, 2024; 16 pages.

Taiwan Intellectual Property Office (the Taiwan Patent Authority), Taiwanese Office Action and Search Report in corresponding Taiwanese Patent Application No. 110144325, dated Feb. 17, 2025, 35 pages.

* cited by examiner

SEWING MACHINE NEEDLE HAVING A RECESS

CROSS REFERENCE TO RELATED APPLICATIONS

This patent application is the national phase of PCT/EP2021/081981, filed Nov. 17, 2021, which claims the benefit of European Patent Application No. 20214663.5, filed Dec. 16, 2020.

TECHNICAL FIELD

Sewing machine needles for industrial sewing machines have been known for many decades and undergo continuous further development. Recent years have seen the growing use of textiles made of synthetic fibres. At the same time, sewing speeds have been increased ever further. A problem in this context is the meltability of synthetic fibres at temperatures that are relatively low for sewing processes. As sewing speeds increase, so too does the heat introduced into the fabric as a result of friction with the needle blade. The consequence is undesirable melting of the synthetic fibre at the needle hole if sewing speeds are too high. In order that sewing speeds may be increased further despite this problem, attempts have already been made to reduce the friction between needle blade and fabric.

BACKGROUND

EP2896732A1 describes a sewing needle with a double-twist groove, which comprises a scarf in which two bevels are disposed. The bevels reduce the cross section of the needle blade in the area of the scarf but they do not lead to a reduction in friction between needle blade and fabric. This is because they are disposed in the scarf at positions where, even in the case of a needle without such bevels, there is no contact with the fabric during sewing.

DE962949C1 describes a sewing machine needle of this kind, which is intended to reduce frictional heat generated during sewing. For this purpose, the sewing machine needle has longitudinal grooves extending from the level of the needle eye to a conical transition between the needle blade and the shank. These grooves are intended to reduce the contact surfaces of the blade with the fabric, thereby also reducing the friction.

EP1391548A1 describes a sewing machine needle comprising concave recesses at two diametrically opposite lateral surfaces of the needle blade. These concave recesses are intended to reduce the contact surfaces between the needle blade and the fabric, and, in consequence, to reduce the friction.

DE3149383A1 describes another example of a sewing machine needle intended to reduce the friction between the needle blade and the fabric. Seen in cross section, the blade has V-shaped profiling and has ribs which are separated by an indentation—similar to a concave recess. The shape of the indentations is adapted to suit the nature and number of the ribs. For example, one embodiment has a star-shaped cross section with seven ribs that are separated from each other by numerous small indentations. Another embodiment has only four ribs, which are separated from each other in each case by a larger indentation. The indentations are recesses which penetrate into the sewing machine needle in such a way as to reduce the needle blade's cross section. The described "geometry" is intended to reduce the contact surface with the fabric and thus to reduce the friction, but to increase the surface area of the needle blade and thereby increase the speed at which the generated heat is transferred to the surrounding air.

Prior art sewing machine needles of this kind have proved to be considerably more expensive to manufacture than customary sewing machine needles and sometimes require additional production steps.

SUMMARY

Starting from the prior art, one objective of the invention is thus to provide a sewing machine needle that reduces the friction between the blade of the sewing machine needle and the fabric and does not require any additional or more complex production steps.

The objective is achieved with a sewing machine needle having the following features:

- a blade, which extends substantially in a longitudinal direction,
- a needle eye, which extends completely through the sewing machine needle in an elevational direction, said elevational direction being at right angles to the longitudinal direction,
- at least one recess, which reduces the reach of the blade in the lateral direction, said lateral direction being at right angles to the elevational and to the longitudinal directions,
- wherein the at least one recess has an upper and a lower edge, at which the recess ends in the elevational direction,
- and wherein the recess has, at least at one point along its length in the longitudinal direction, a height which corresponds to at least 30% of the height of the blade at the point in question (the recess accordingly has, in a plane defined by the lateral and elevational directions, at least one cross section in which the height of the recess corresponds to at least 30% of the height of the blade in this cross section), and in the case of which, in addition, an upper edge distance, which corresponds to the distance, in the lateral direction, between the upper edge of the recess and the position of the axis of the needle eye in the lateral direction, differs from a lower edge distance corresponding to the distance, in the lateral direction, between the lower edge of the recess and the position of the axis of the needle eye in the lateral direction. The sewing machine needle advantageously has a clamping portion—usually a shank—which, in a plane defined by the lateral direction and elevational directions, has a larger cross section than the blade and is followed, in the longitudinal direction on the needle-eye side, by a transition portion. In a plane defined by the lateral and elevational directions, the cross section of this transition portion tapers towards the needle eye in the longitudinal direction. In the case of needles having a transition portion of this kind, the blade adjoins the transition portion in the longitudinal direction on the needle-eye side. The tapering of the transition portion may be achieved in various ways. All kinds of transition portion between a blade and a clamping portion that are known to persons skilled in the art are conceivable. For example, the transition portion may be substantially conical, with the axis of the cone running in the longitudinal direction. It is equally possible for the surface of the sewing machine needle to have a step or a radius in the transition portion. The formation of a recess in a sewing machine needle according to the invention may be integrated in production steps already known to persons skilled in the art. The recess or a plurality of recesses may be produced simultaneously with a tool movement in elevational and/or longitudinal direction, thereby enabling efficient serial production. The recesses in the sewing machine needle may be produced using cutting methods such as milling, and/or forming methods such as forging or pressing. Provided the tool is adapted to the geometry of the longitudinal recess, the only requirement is a tool movement in elevational and/or longitudinal direction, irrespective of the number and position of the recesses. The recess is formed by processing a needle blank and reduces the cross-sectional surface area of the needle blank in the plane defined by the lateral and elevational directions in the manner described above. Prior to processing, the needle blank may have a variety of cross-sectional shapes, for example, circular, oval, trapezoidal or triangular. A triangular shape with rounded corners is also conceivable. Other shapes not explicitly mentioned may be equally advantageous. A sewing machine needle comprising at least two recesses is also to advantage, the upper-edge distance differing from the lower-edge distance in the case of each recess. It is particularly advantageous if the recesses are arranged in such a way that the sewing machine needle is symmetrical along a plane defined by the axis of the needle eye and the longitudinal direction.

It is advantageous if the recess has a uniformly shaped section making up at least 10%, preferably, however, at least 20% of the entire reach of the recess in the longitudinal direction and if the height of the recess at every point on the uniformly shaped section corresponds to at least 30% of the height of the blade at the point in question. In this way, friction is reduced over a largish portion of the sewing machine needle. The uniformly shaped section does not include the entry and exit parts of the recess. These are the end portions of the recess, pointing in the longitudinal direction. In the entry and exit parts of the recess, the upper and lower edges generally approach each other in the elevational direction until they are touching. It is advantageous if the height of the recess in the elevational direction is at a maximum at least at one point along the length of the uniformly shaped section. The uniformly shaped section of the recess is a part of the blade—i.e. the blade includes the uniformly shaped section of the recess.

Further advantages are obtained if the upper edge distance is smaller than the lower edge distance. A sewing machine needle in the case of which, at least in the uniformly shaped section of the recess, the upper edge distance is smaller than the lower edge distance is particularly advantageous. A geometry of this kind is especially beneficial if, during at least one production step, the tool performs a movement having a directional component in elevational direction, starting out from the upper edge towards the lower edge, or in lateral direction. The upper edge delimits the recess in the positive elevational direction. The lower edge delimits the recess in the negative elevational direction. The positive elevational direction is the direction from the lower edge towards the upper edge. The negative elevational direction is accordingly the opposite, from the upper edge towards the lower edge. This definition of positive and negative elevational directions applies to all possible embodiments of the teaching according to the invention. In a preferred embodiment, the sewing machine needle comprises at least one scarf and/or at least one thread groove, the scarf being disposed on the upper side, which points in the positive elevational direction, and the thread groove preferably being disposed on the underside, which points in the negative elevational direction. A thread groove may also be disposed on the upper side, which points in the positive elevational direction.

Further advantages are obtained for all embodiments if the sewing machine needle comprises a scarf, which is preferably produced by a forming process and if the at least one recess and the scarf at least partially overlap in the longitudinal direction.

Scarves in connection with sewing machine needles are already known to persons skilled in the art. Every known embodiment of a scarf is advantageous. By "overlap in the longitudinal direction" is meant that the scarf and the recess are at least partially parallel in the longitudinal direction, i.e. they are not spaced apart in the longitudinal direction. It is particularly beneficial if the recess overlaps with the scarf by at least 10% of the scarf length in longitudinal direction, preferably, however, by at least 70% of the scarf length in longitudinal direction. The scarf length is the length, in the needle's longitudinal direction, along which the surface of the needle in the scarf portion is depressed in elevational direction compared to the surrounding needle portions. The scarf length thus includes an entry and an exit part of the scarf. The blade of a sewing machine needle with a scarf can be divided into two sub-portions, the principal blade portion and the scarf portion. The scarf portion is the portion in which the scarf, including its entry and exit parts, extends in the longitudinal direction. The principal blade portion is the remaining portion of the blade. It is to advantage if the uniformly shaped recess section described above does not overlap with the scarf portion. The uniformly shaped section of the recess advantageously lies completely within the principal blade portion—i.e. it overlaps completely with the principal blade portion in the longitudinal direction. The principal blade portion advantageously has a uniform cross section in the longitudinal direction (cylindrical blade) or a slightly tapering cross section in the longitudinal direction (conical blade). The recesses in a blade may be "conical" as well, i.e. their shape may taper in the longitudinal direction towards the needle eye, irrespective of the blade's shape. However, the recesses may also be "cylindrical", i.e. maintain the same shape and position in the longitudinal direction, irrespective of how the rest of the blade is shaped. In this case, the lateral distance function s(h) in the uniformly shaped section of the recess is the same at every position along the length of the uniformly shaped section. Accordingly, various different combinations are possible, for example:

a cylindrical blade with cylindrical recesses, a cylindrical blade with conical recesses, a conical blade with cylindrical recesses or a conical blade with conical recesses.

It is advantageous for all embodiments of the sewing machine needle if, at least at one point along the length of the recess in the longitudinal direction, preferably, however, at every point along the length of the uniformly shaped section, it holds that the maximum distance in the elevational direction between the upper edge of the recess and the highest point of the blade is 35% of the blade height, preferably, however, 25% of the blade height. In this way, large recesses are obtained, which effectively reduce the frictional surface between sewing machine needle and fabric.

It is advantageous if a lateral distance function s(h), which describes, dependent on a height coordinate h, the distance in the lateral direction between the surface of the sewing machine needle and the axis of the needle eye, decreases monotonically, preferably strictly monotonically, with increasing height over at least 90% of the recess's elevational reach, preferably, however, the entire elevational reach of the recess. The elevational reach of the recess is the extension of the recess in elevational direction. In this way, undercuts are avoided and the production process additionally facilitated. The lateral distance function s(h) is also the function of the sectional curve of the surface of the sewing machine needle in the plane defined by the elevational direction and the lateral direction, which describes, dependent on a height coordinate h, the lateral distance between the surface of the sewing machine needle and the axis of the needle eye in the lateral direction. The height coordinate h increases in positive elevational direction H. It is to advantage if the first derivative of the lateral distance function s'(h) is negative for height coordinates smaller than the height coordinate $h_O$ of the upper edge and larger than the height coordinate $h_U$ of the lower edge—i.e. $s'(h)<0$ if $h_U<h<h_O$. It is especially beneficial if the second derivative of the lateral distance function s"(h) is less than or equal to zero for height coordinates smaller than the height coordinate $h_U$ of the lower edge or larger than the height coordinate $h_O$ of the upper edge—i.e. $s''(h)\leq 0$ if $h>h_O$ or $h<h_U$.

At least one recess which, in lateral direction, is spaced at every point from the position of the axis of the needle eye shows further positive effects. It is to advantage if the distance, in lateral direction, between the recess and the position of the axis of the needle eye is greater than zero at every point of the recess. In this way, a plane defined by the axis of the needle eye and the longitudinal direction does not intersect the recess. A needle having at least two such recesses, which are symmetrical with respect to a plane defined by the axis of the needle eye and the longitudinal direction, is particularly advantageous.

Advantageous embodiments are obtained if an imaginary lead-in tangent to the recess at the upper edge encloses a lead-in angle of 5° to 70°, preferably, however, 10° to 40°, with the elevational direction. The lead-in tangent is a tangent adjoining the surface of the recess in the plane defined by the lateral and elevational directions. The lead-in tangent touches the upper edge. In the upper-edge area, the recess may be rounded to varying extents depending on the manufacturing method. The lead-in tangent is not tangential to roundings of this kind, in which the gradient of the surface in the plane defined by the elevational and lateral directions changes extensively. In a preferred embodiment, the lead-in tangent makes contact with the recess in a concave area of its surface. It is particularly advantageous if an imaginary tangent in the plane defined by the lateral and elevational directions encloses an angle of at least 5°, preferably, however, at least 10°, at every point of the recess surface.

The sewing machine needle may advantageously comprise at least one thread groove, which extends substantially in the longitudinal direction, follows on from the needle eye in the negative longitudinal direction, i.e. in the direction looking from the needle eye towards the blade, and constitutes a depression in the elevational direction. In a preferred embodiment, the thread groove is disposed on the underside of the needle, which points in the negative elevational direction. The thread groove is then "open" in the negative elevational direction—i.e. it is not delimited in the negative elevational direction by material of the sewing machine needle. However, a thread groove may also be disposed on the upper side, which points in the positive elevational direction. The thread groove is then "open" in the positive elevational direction. The thread groove is suitable for receiving a thread running through the needle eye and for guiding it along the blade in longitudinal direction. A thread groove that ends in the needle eye offers advantages. The thread groove and the needle eye then merge into each other in the longitudinal direction—i.e. no needle material is disposed between the needle eye and the thread groove. However, the thread groove may also be spaced from the needle eye. The thread groove is a slot-like depression in the needle blade. The groove is delimited on one side in the elevational direction and on both sides in the lateral direction by needle material. It is advantageous for the sewing machine needle to comprise two thread grooves. A sewing machine needle comprising a first thread groove on its underside and a second thread groove on its upper side is particularly advantageous.

It is advantageous if, at least at one point along the length of the recess in the longitudinal direction, preferably, however, at every point along the length of the uniformly shaped section, it holds that the surface of the sewing machine needle between the lower edge and the upper edge of the recess in a plane defined by the elevational and lateral directions is shaped as a circular arc with a substantially constant radius, wherein the circular arc centre preferably lies outside the cross-sectional area of the sewing machine needle in the plane defined by the elevational and lateral directions. In this sectional plane, accordingly, the surface of the recess has the shape of a circular arc and the radius is the same at every point on this circular arc. This kind of recess shape is easy to produce, both with cutting and with forming production methods. Additional advantages are obtained if, in a plane defined by the elevational and lateral directions, the surface of the sewing machine needle between the lower edge and the upper edges of the recess has a shape made up of a circular arc and, adjoining the circular arc, a straight line. This straight line preferably adjoins the circular arc tangentially.

Further advantages are offered by a sewing machine needle in the case of which, at least at one point along the length of the recess in the longitudinal direction, preferably, however, at every point along the length of the uniformly shaped section, it holds that the recess height, which corresponds to the distance between the upper and lower edges in the elevational direction, is 60% to 170% of the maximum lateral distance function s(h), preferably, however, 75% to 160% of the maximum lateral distance function s(h). The selection ranges mentioned have proved advantageous for sewing machine needles having customary dimensions because they enable the use of simple production methods and simultaneously make for sewing machine needles which generate little friction with the textile during sewing. Advantages are also offered by a sewing machine needle in the case of which, at least at one point along the length of the scarf, preferably, however, for at least 20% of the length of the scarf, the recess height, which corresponds to the distance between the upper and lower edges in the elevational direction, is 25% to 150% of the maximum lateral distance function s(h), preferably, however, 35% to 105% of the maximum lateral distance function s(h). Particularly advantageous is a sewing machine needle in the case of which, at least for 20% of the length of the scarf portion, it holds that the recess height, which corresponds to the distance between the upper and lower edges in the elevational direction, is 35% to 60% of the maximum lateral distance function s(h).

Further advantages are offered by a sewing machine needle in the case of which, at least at one point along the length of the recess in the longitudinal direction, preferably, however, at every point along the length of the uniformly shaped section, it holds that the upper edge distance O is 10% to 60% of the maximum lateral distance function s(h), preferably, however, 25% to 45% of the maximum lateral distance function s(h). The upper edge distance O corresponds to the value of the lateral distance function at the position of the upper-edge height coordinate $h_O$. In other words, $O=s(h_O)$. The selection ranges mentioned have proved advantageous for sewing machine needles having customary dimensions because they allow a recess of maximum possible size, thus making for the maximum possible reduction in friction, and yet are easy to manufacture, and because they guarantee sufficient stability of the sewing machine needle. Advantages are offered by a sewing machine needle in the case of which, at least at one point along the length of the scarf portion, preferably, however, for at least 20% of the length of the scarf portion, the upper edge distance O, is 10% to 75% of the maximum lateral distance function s(h), preferably, however, 35% to 65% of the maximum lateral distance function s(h).

Further advantages are offered by a sewing machine needle in the case of which, at least at one point along the length of the recess in the longitudinal direction, preferably, however, at every point along the length of the uniformly shaped section, it holds that the lower edge distance U is 50% to 100% of the maximum lateral distance function s(h), preferably, however, 70% to 95% of the maximum lateral distance function s(h). The lower edge distance U corresponds to the value of the lateral distance function at the position of the lower-edge height coordinate $h_U$. In other words, $U=s(h_U)$. The selection ranges mentioned have proved advantageous for sewing machine needles having customary dimensions because they allow a recess of maximum possible size, thus making for the maximum possible reduction in friction, and yet are easy to manufacture, and because they guarantee sufficient stability of the sewing machine needle. Advantages are offered by a sewing machine needle in the case of which, at every point along the length of the scarf portion, it holds that the lower edge distance U is 50% to 100% of the maximum lateral distance function s(h), preferably, however, 70% to 95% of the maximum lateral distance function s(h).

A method for the production of a sewing machine needle having a blade, which extends substantially in a longitudinal direction, and a needle eye, which extends through the sewing machine needle in an elevational direction that is at right angles to the longitudinal direction, achieves the objective of the invention in that

- at least one recess, which is delimited in the elevational direction by an upper edge and a lower edge,
- and in the case of which an upper edge distance corresponding to the distance, in the lateral direction, between the upper edge of the recess and the position of the axis of the needle eye in the lateral direction differs from
- a lower-edge distance corresponding to the distance, in the lateral direction, between the lower edge of the recess and the position of the axis of the needle eye in the lateral direction
- is produced by a tool movement exclusively in the elevational direction and/or longitudinal direction.

A tool movement which is limited to two or even just one movement direction makes for a particularly efficient production process. Large numbers of sewing machine needles can be produced in series with a method of this kind. A method of this kind is particularly advantageous for a sewing machine needle in the case of which the recess has, at least at one point along its length in the longitudinal direction, a height which corresponds to at least 30% of the height of the blade at the point in question.

Further advantages are offered by a method in which the at least one recess is produced by a separating process, preferably by milling. If the milling cutter has a contour corresponding to that of the recess, the recess can be produced by a movement in horizontal and longitudinal direction. An additional movement in lateral direction is unnecessary. This procedure may be used to advantage with other separating-type manufacturing methods as well—for example grinding or spark erosion.

Further advantages are offered by a method in which the at least one recess is produced by a forming process, preferably by pressing. If the press consists of an upper die and a lower die which copy the contour of the at least one recess or of a plurality of recesses, the recess can be produced by a tool movement exclusively in the elevational direction. This is a particularly easy and efficient way of making the recess in the sewing machine needle. However, the recess may also produced by forming with a press having more than two dies—for example a press having three, four or five dies.

DETAILED DESCRIPTION

Figure 1:
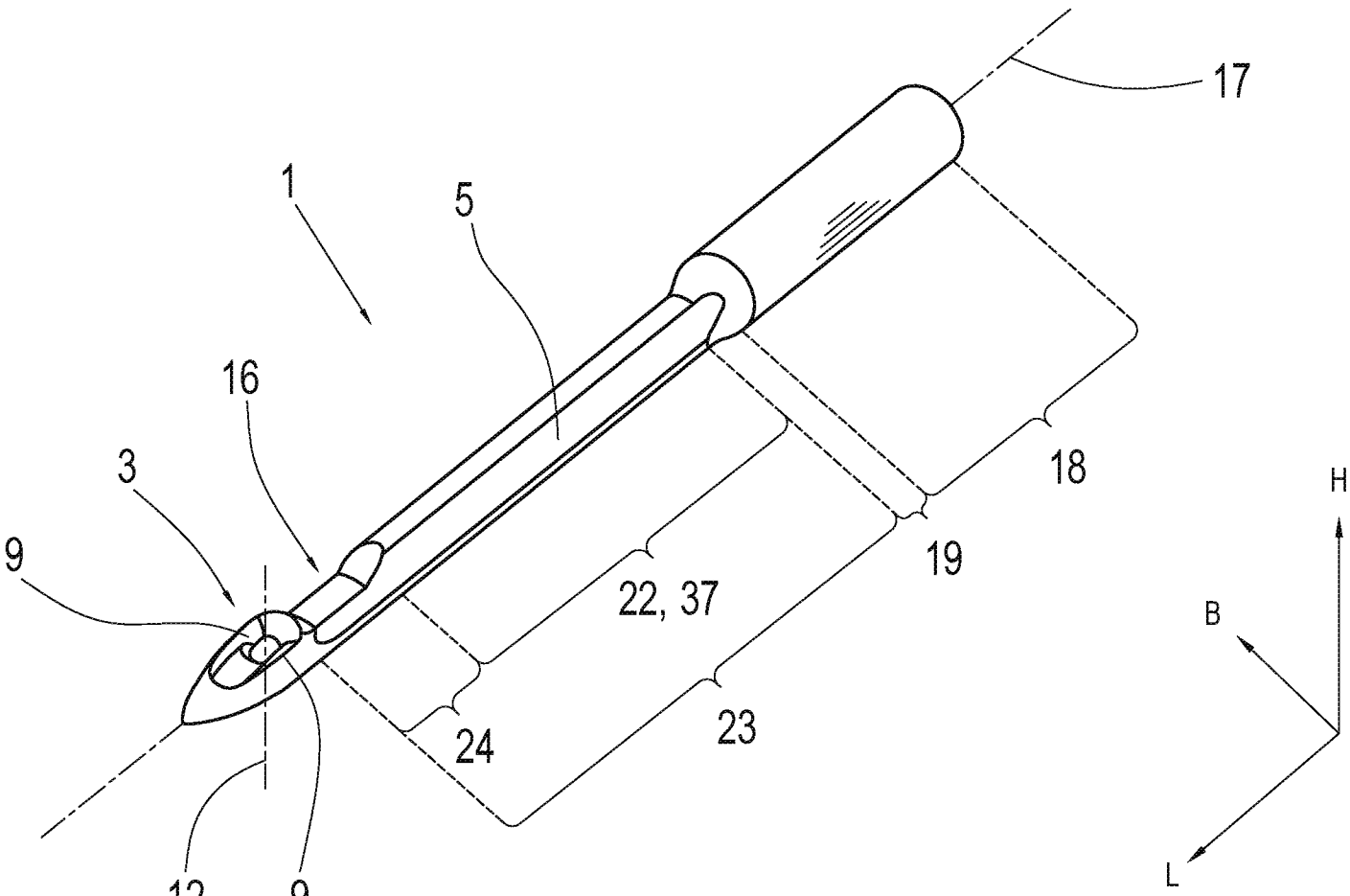
FIG. 1 shows a sewing machine needle (1) with a recess (5).

FIG. 1 shows a three-dimensional view of a sewing machine needle 1 with a recess 5 (a second recess 5 is obscured in this view). The sewing machine needle 1 comprises a clamping portion 18, a transition portion 19, a blade portion 23, a principal blade portion 22, a uniformly shaped section 37, a scarf 16 and a needle eye 3. The axis 12 of the needle eye 3 runs in the elevational direction H. In the lateral direction B, it is located exactly in the centre between the two side walls 9 of the needle eye 3. In this embodiment, the uniformly shaped section 37 corresponds to the principal blade portion 22, i.e. the two portions overlap completely. In other embodiments of the teaching according to the invention it may be advantageous for the principal blade portion 22 and the uniformly shaped section 37 to overlap only partially. The uniformly shaped section does not overlap here with the scarf portion 24.

Figure 2:
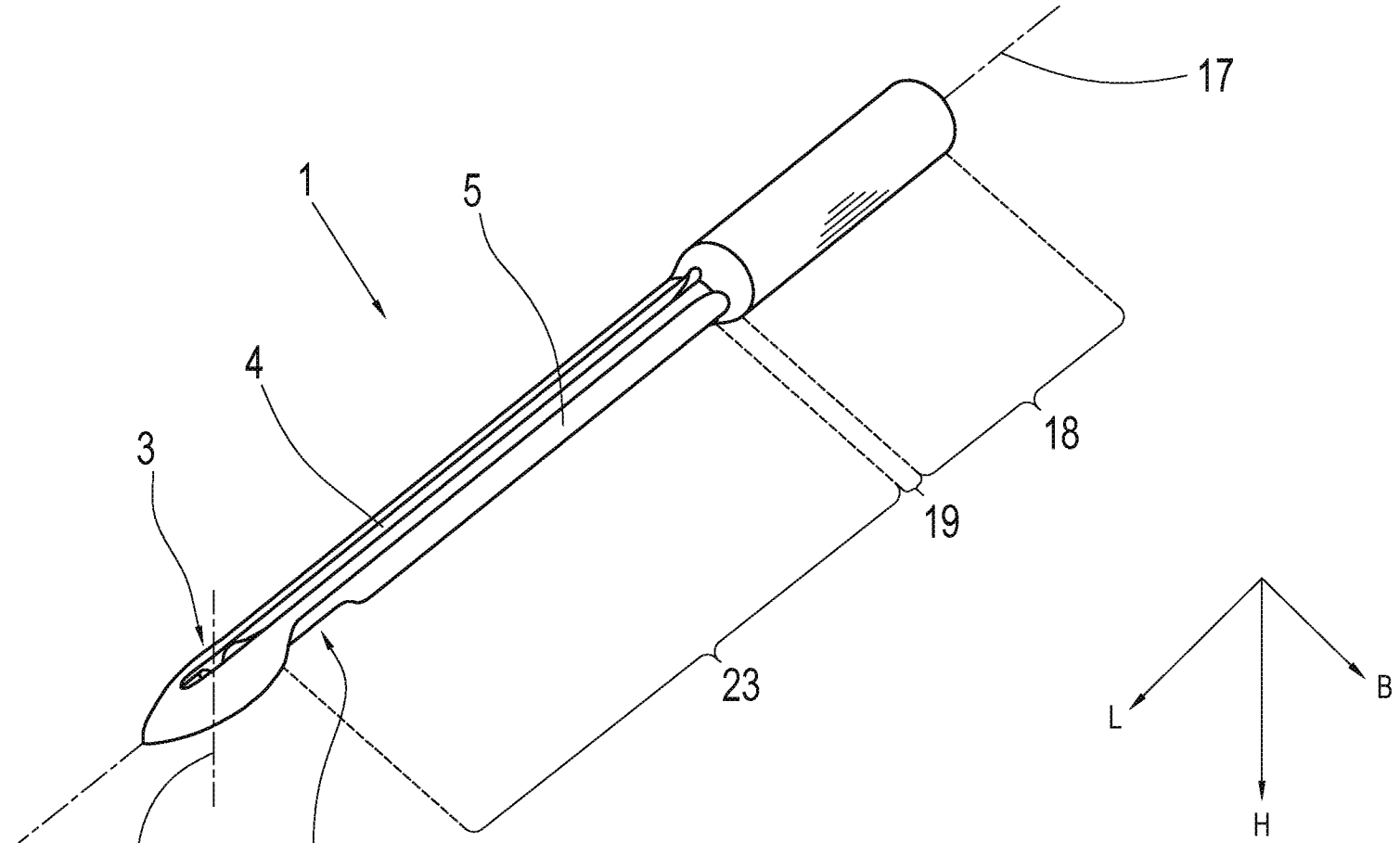
FIG. 2 shows the same sewing machine needle (1) as FIG. 1 as viewed after turning it by 180° about the needle axis.

FIG. 2 shows the sewing machine needle from FIG. 1 as viewed after turning it by 180° about the longitudinal axis 17. On the underside of the sewing machine needle 1, pointing in the negative elevational direction H, a thread groove 4 extends in the longitudinal direction L from the needle eye 3 into the transition portion 19. Thus, in the longitudinal direction L, the thread guide 4 overlaps with the blade portion 23 and the transition portion 19.

Figure 3:
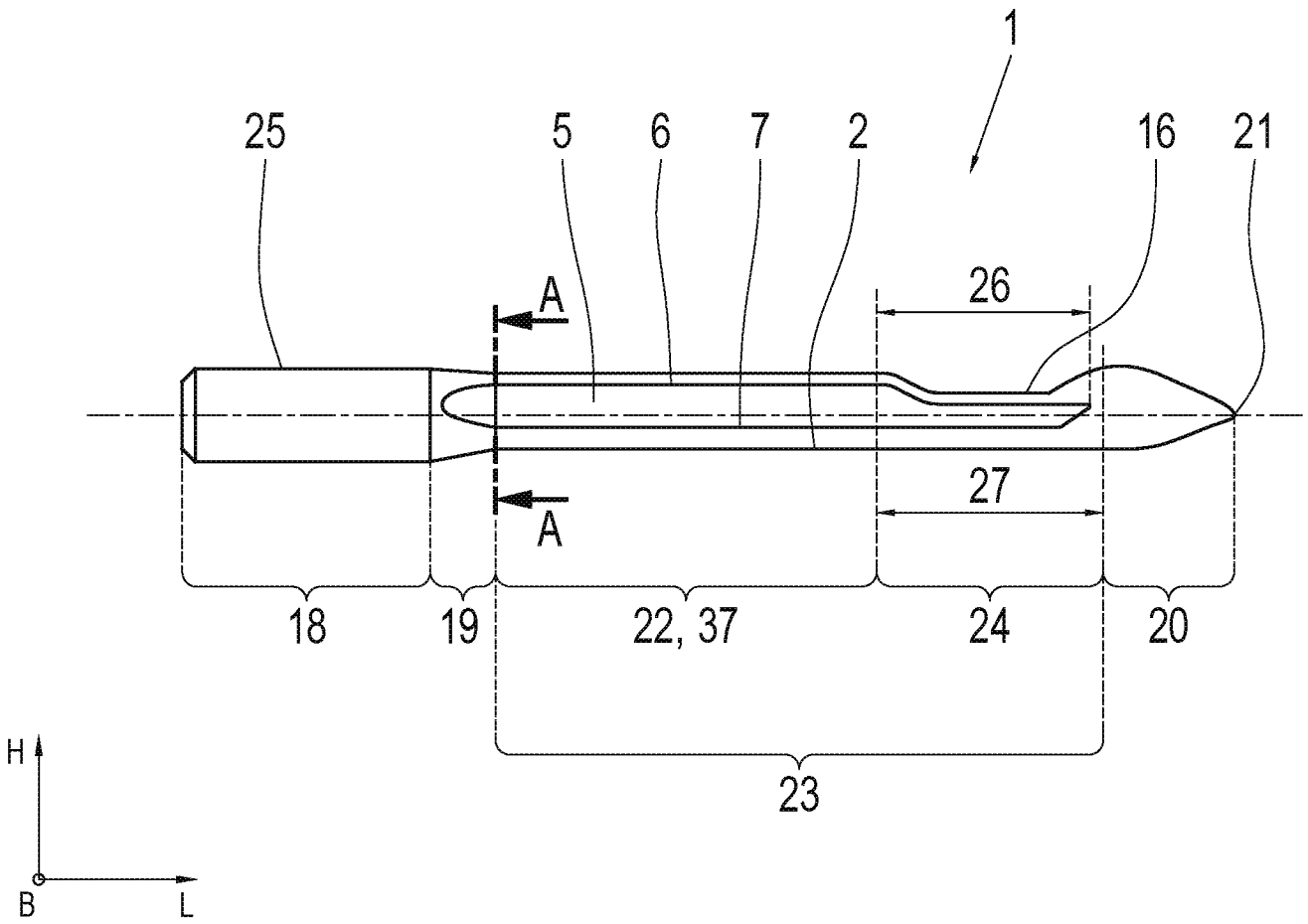
FIG. 3 shows a side view of the sewing machine needle (1) with a recess (5).

FIG. 3 shows a side view of the sewing machine needle 1 with a clamping portion 18, a blade portion 23 and a tapering portion 20. It is to advantage for all embodiments of the needle if a shank 25 is disposed in the clamping portion 18. In all embodiments, the clamping portion 18 is suitable to be received in a sewing machine and driven longitudinally producing a sewing motion. The blade portion 23 is the portion within which the blade 2 extends in the longitudinal direction. It comprises a principal blade portion 22 and a scarf portion 24. Looking in the longitudinal direction L towards the needle eye 3, the principal blade portion 22 precedes the scarf portion 24. The scarf portion 24 is the portion within which the scarf 16 extends in the longitudinal direction L. In the principal blade portion 22, the blade 2 has a uniform cross section along the longitudinal direction L. Persons skilled in the art use the term cylindrical here. It may be equally advantageous for all embodiments of the invention if, in the principal blade portion 22, the cross section of the blade 2 decreases in the longitudinal direction L towards the needle eye 3. Persons skilled in the art then describe the blade as being conical. The blade portion 23 has a smaller cross section than the clamping portion 18. A conical transition area 19 between the clamping portion 18 and the blade portion 23, or the principal blade portion 22, equalises this difference in cross section between the clamping portion 18 and the blade portion 23. Looking in the longitudinal direction L away from the clamping portion 18, a tapering portion 20 adjoins the blade portion 23. In this portion, the needle's cross section decreases monotonically and terminates with the needle point 21. Located in the blade portion 23 is a recess 5, a section of which, in the longitudinal direction L, also overlaps with the transition portion 19. The recess comprises a uniformly shaped section 37 that overlaps entirely with the principal blade portion 22. The uniformly shaped section 37 is delimited in the longitudinal direction L at the same positions as the principal blade portion 22. However, in other embodiments of the teaching according to the invention, the limits defining the uniformly shaped section 37 may deviate from those defining the principal blade portion 22. The recess 5 is delimited in the elevational direction by the upper edge 6 and the lower edge 7. It is also advantageous for all embodiments if the recess 5 lies fully within the blade portion 23—i.e. both the beginning and end of the recess 5 in the longitudinal direction L lie within the blade portion 23. In the longitudinal direction, the recess 5 overlaps with the scarf 16 by the overlap length 26. A section of the recess is thus also in the scarf portion 24. In this example, the overlap length 26 corresponds to 90% of the scarf length 27 in the longitudinal direction L. It is advantageous for all embodiments, however, if the overlap length 26 is at least 10% of the scarf length 27, preferably at least 70% thereof. It may be equally advantageous for sewing machine needles 1 according to the invention if the recess 5 does not overlap with the scarf 16 in the longitudinal direction L.

Figure 4:
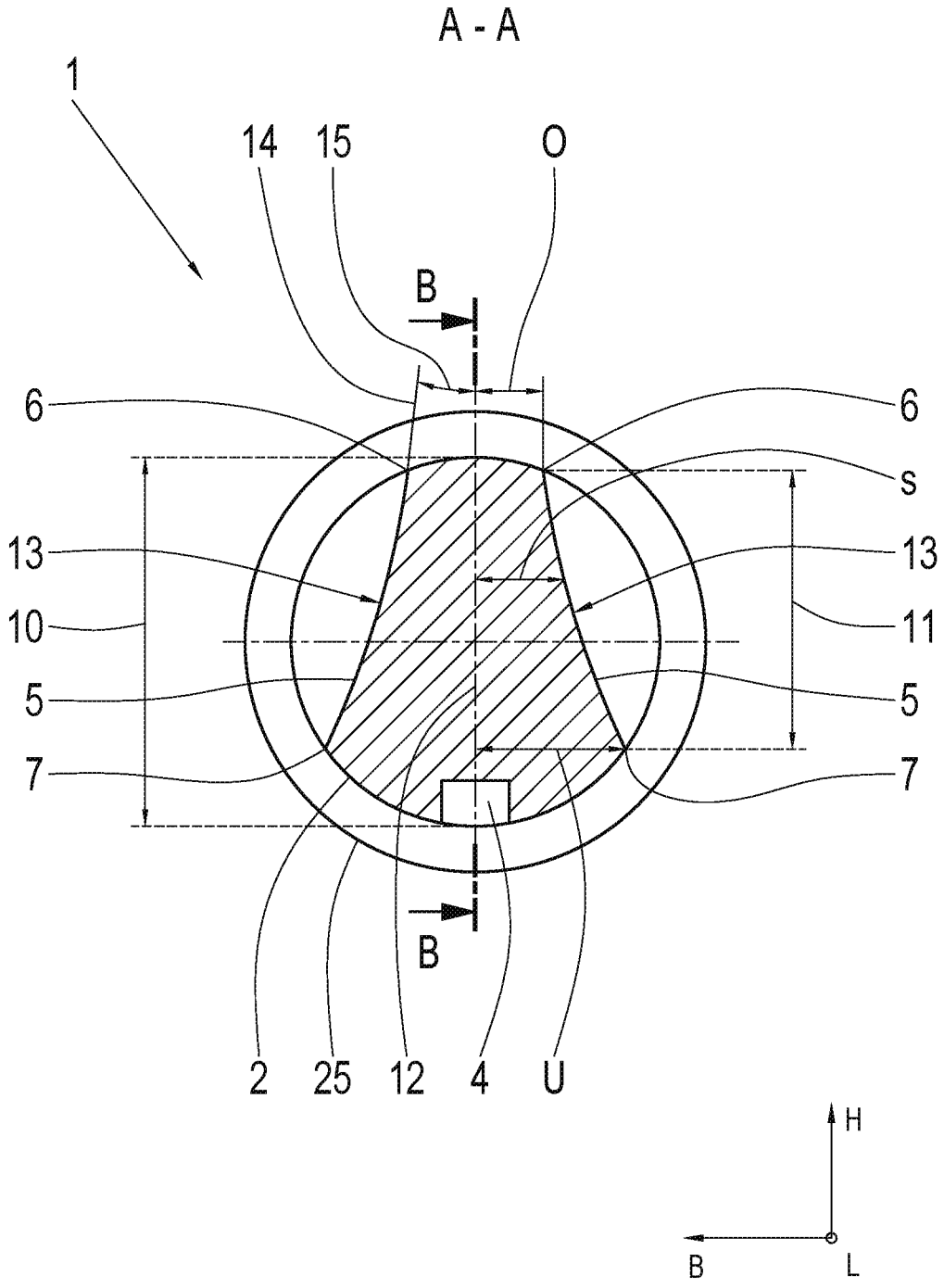
FIG. 4 shows the A-A section through the sewing machine needle (1) from FIG. 3 in a plane defined by the lateral (B) and elevational (H) directions.

FIG. 4 shows the A-A section through a sewing machine needle 1 at the position shown in FIG. 3. In the longitudinal direction L, the section is located at the end of the blade portion 23, directly before the transition portion 19 commences. It thus shows the cross section of the blade 2 which is furthest from the needle eye 3 in the longitudinal direction L. The blade 2 has two recesses 5 and a thread groove 4. The recesses 5 reduce the cross section of the blade 2 and have a concave shape in the sectional plane. Behind the sectional plane, the shank 25 is visible, which has a larger cross section than the blade 2. The upper edge 6 and lower edge 7 are cut by the sectional plane and delimit the recesses 5 in the elevational direction H both upwardly and downwardly. FIG. 4 also shows the position, in the lateral direction, of the axis 12 of the needle eye 3. In the lateral direction B, each of the upper edges 6 is spaced from the axis 12 of the needle eye 3 by an upper edge distance O. In the lateral direction B, each of the lower edges 7 is spaced from the axis 12 of the needle eye 3 by a lower edge distance U. The upper edge distance O and the lower edge distance U differ in magnitude: in this case, the upper edge distance O is smaller than the lower edge distance U. The recess height 11, which, in all embodiments of the invention, corresponds to the distance between the upper edge 6 and the lower edge 7 in the elevational direction H, is more than 30% of the shank height 10 of the blade 2 in the elevational direction H. In the lateral direction, the surface 13 of the sewing machine needle 1 is spaced from the position of the axis 12 of the needle eye 3 by the lateral distance s. The lateral distance s may be described by a lateral distance function s(h), which is dependent on the height coordinate h in the elevational direction, i.e.

$s=f(h)=s(h)$. A lead-in tangent 14 which adjoins the curve of the lateral distance function s(h) tangentially at the upper edge 6 of the recess 5, in the end area thereof, encloses a lead-in angle 15 greater than 5° with the elevational direction H. However, the selection ranges for the lead-in angle 15 which have been mentioned in the earlier paragraphs are advantageous for all embodiments of the sewing machine needle 1.

Figure 5:
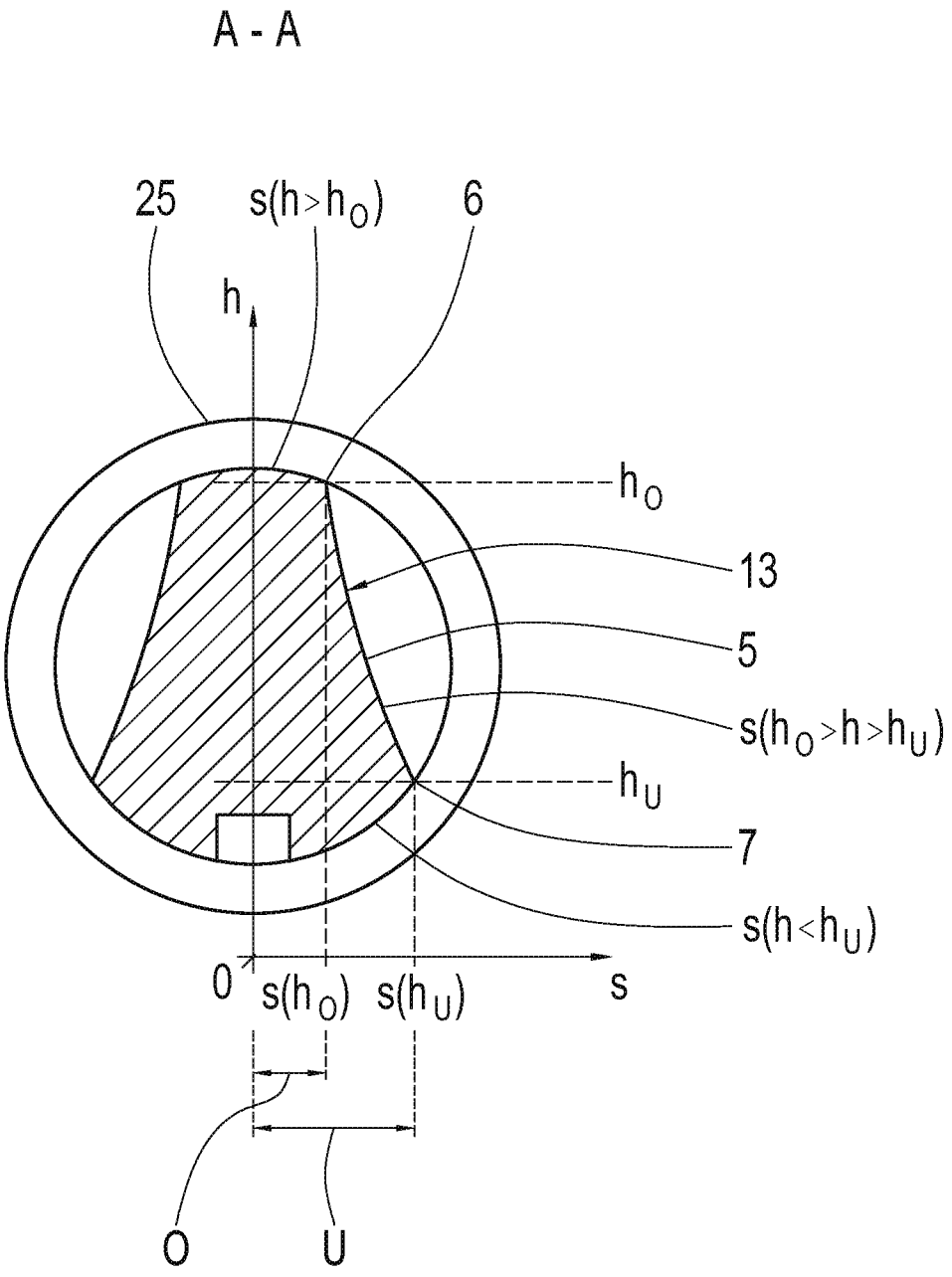
FIG. 5 shows the same section as FIG. 4 and the progression of the lateral distance function s(h).

FIG. 5 depicts the same section as FIG. 4 and shows, once again, the lateral distance function s(h). The upper edge distance O corresponds to the value of the lateral distance function s(h) at the height coordinate $h_O$ of the upper edge 6, i.e. $O=s(h_O)$. The lower edge distance U corresponds to the value of the lateral distance function s(h) at the height coordinate $h_U$ of the lower edge 7, i.e. $U=s(h_U)$. In this embodiment, the lateral distance s decreases strictly monotonically within the elevational reach of the recess 5 as the height coordinate increases in the elevational direction. Over the entire recess height 11, therefore, it holds that the derivative of the lateral distance function s(h) is less than zero ($s'(h)<0$ for $h_O>h>h_U$). A curve progression of this kind may be advantageous for all the embodiments. In just the same way, it is also advantageous for all variants if the lateral distance decreases monotonically with increasing height, i.e. the derivative of the lateral distance function s(h) is less than or equal to zero ($s'(h)\leq 0$ for $h_O>h>h_U$). The second derivative of the lateral distance function s"(h) for height coordinates smaller than the height coordinate $h_U$ of the lower edge 7 and for height coordinates larger than the height coordinate $h_O$ of the upper edge 6 is less than zero ($s''(h)<0$ if $h>h_O$ or $h<h_U$).

Figure 6:
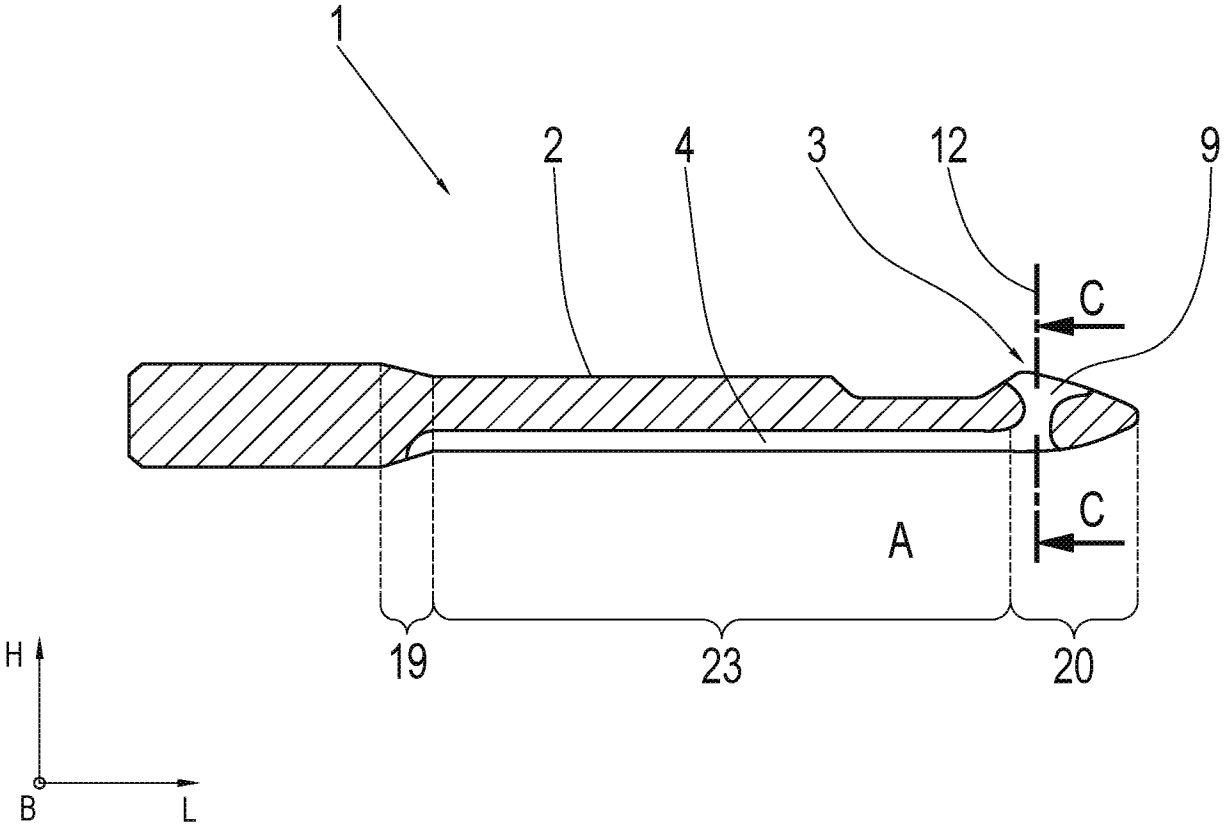
FIG. 6 shows the B-B section through the sewing machine needle (1) from FIG. 3 and FIG. 4 in a plane defined by the elevational direction (H) and the longitudinal direction (L).

FIG. 6 shows the section B-B through the sewing machine needle 1 in a plane defined by the axis 12 of the needle eye 3 and the longitudinal direction L. The position of the section B-B is also shown in FIG. 4. The needle eye 3 is located in the tapering portion 20 of the sewing machine needle 1. In the longitudinal direction, the axis 12 of the needle eye 3 lies centrally in the needle eye 3. Behind the sectional plane, as seen by the observer, the needle eye 3 is delimited in the lateral direction B by a side wall 9. On the underside of the sewing machine needle 1, a thread groove 4 adjoins the needle eye 3. The needle eye 3 and the thread groove 4 are not spaced from one another in the longitudinal direction L but merge into each other. The thread groove 4 runs through the entire blade portion 23 and ends within the transition portion 19. The thread groove 4 is a depression in the blade 2 of the sewing machine needle 1 and is suited to receive a sewing thread during the sewing process. A large variety of thread grooves 4 have been known for many years to persons skilled in the art. The teaching according to the invention can be combined to advantage with every form and shape of thread groove 4.

Figure 7:
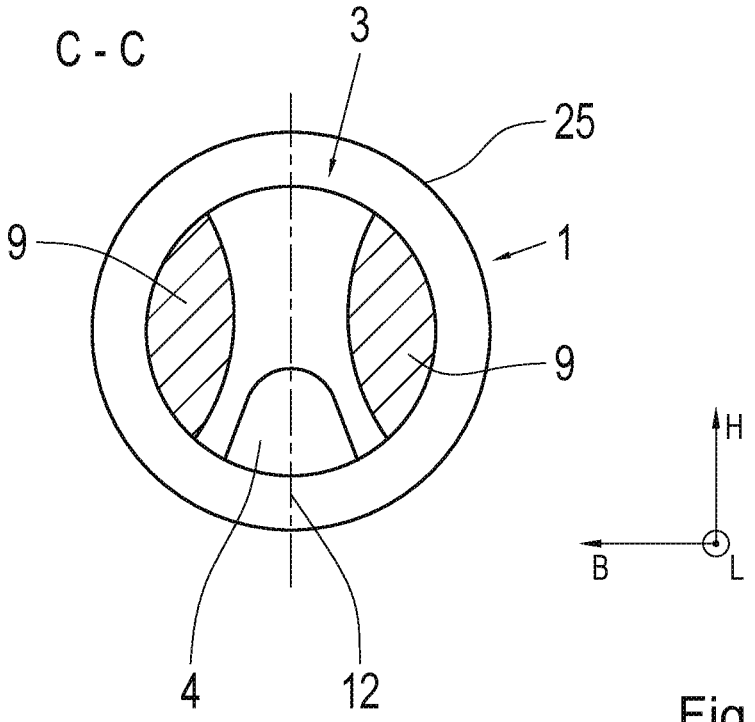
FIG. 7 shows a section through the sewing machine needle (1) at the position of the needle eye (3).

FIG. 7 shows the same section C-C through a sewing machine needle 1 as FIG. 6 at the position of the needle eye 3 in a plane defined by the elevational direction H and the lateral direction B. The position of the section C-C is indicated in FIG. 6. In the lateral direction B, the needle eye 3 is delimited on each side by a side wall 9. In the lateral direction B, the axis 12 of the needle eye 3 runs exactly centrally through the needle eye 3. The axis 12 of the needle eye 3 has this position in the lateral direction B in all other embodiments of the invention as well. Also visible, on the underside of the sewing machine needle 1, is the thread groove 4, which directly adjoins the needle eye 3.

Figure 8:
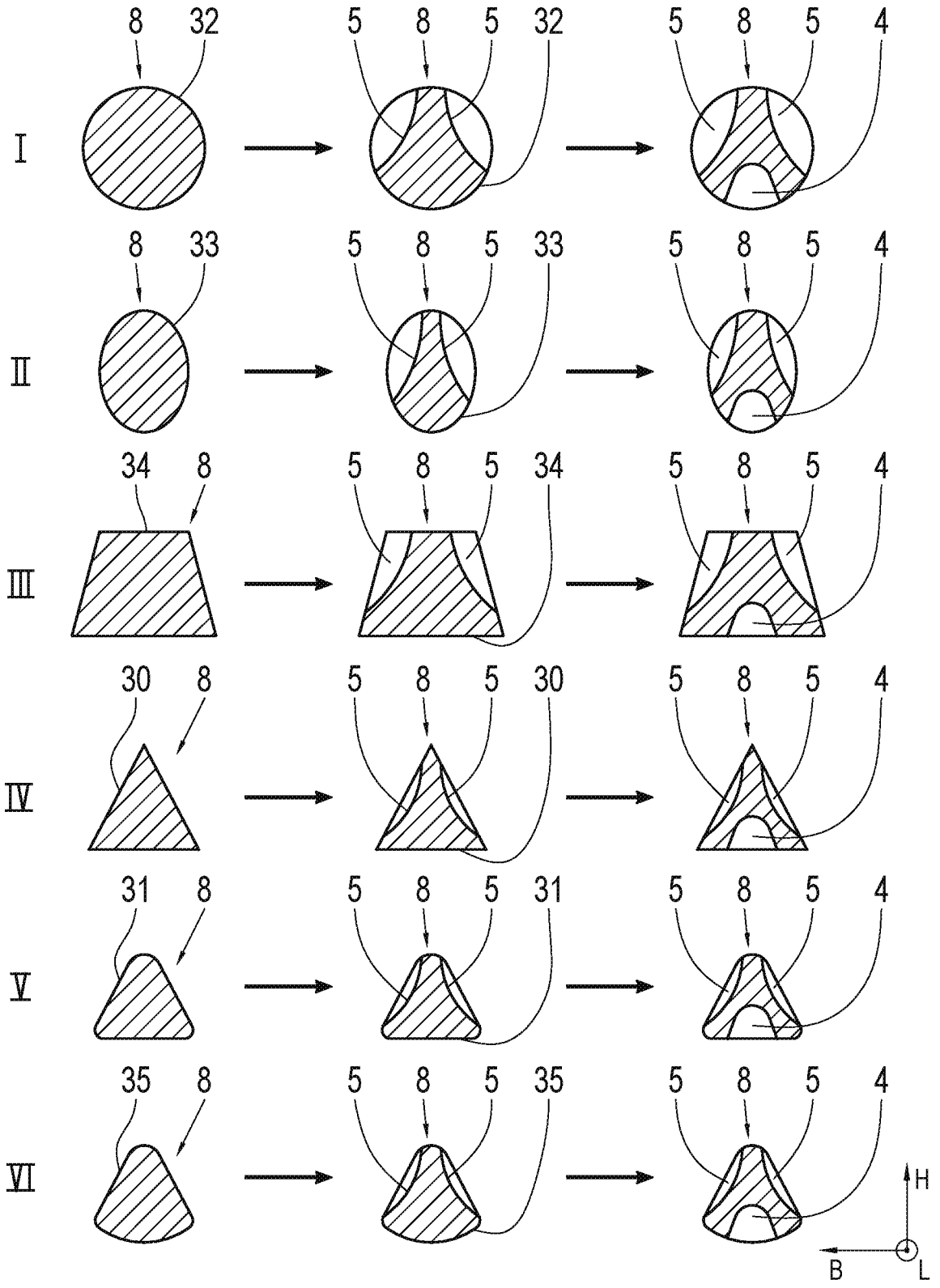
FIG. 8 shows a variety of needle blanks (8) and the reduction in their cross sections by recesses (5) and thread grooves (4).

FIG. 8 shows possible shapes for a needle blank 8 and a possible arrangement of recesses 5 for each shape. The cross section of the needle blank 8 may be round 32, oval 33, trapezoidal 34, triangular 30 or triangular with rounded corners 31. The needle blank may, however, also have a cross-sectional shape 35 consisting of two arcs having different radii and two obliquely oriented straight lines which connect the arcs with each other. It is evident from the second column of FIG. 8 how recesses 5 according to the invention reduce the cross section of needle blanks 8 having these shapes. The third column of FIG. 8 shows how a thread groove 4 reduces the cross section of needle blanks 8 having these shapes. The teaching of the invention may also be used to advantage for needle blanks 8 having all other already-known cross-sectional shapes for sewing machine needles 1.

Figure 9:
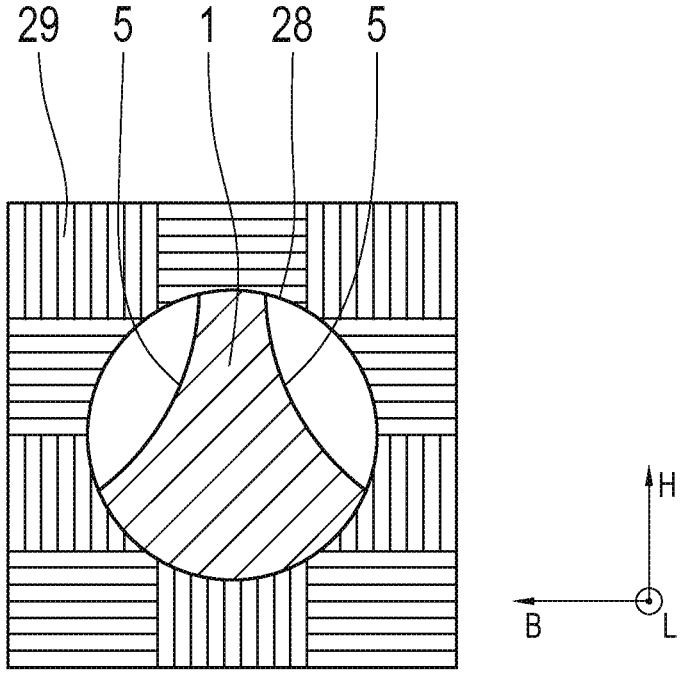
FIG. 9 shows a section through a sewing machine needle (1) and a textile fabric (29) with a needle hole (28).

FIG. 9 shows a section through a sewing machine needle 1 and a fabric 29 at the position of a needle hole 28 in the textile fabric 29. The fabric 29 is not in contact with the sewing machine needle 1 in the area of the recesses 5. Here, therefore, there can be no friction, resulting in a reduction in the overall friction between the sewing machine needle 1 and the fabric 29. The needle hole 28 is shown in FIG. 9 as an idealised circle. Other shapes may be obtained for the needle hole 28 depending on the textile and mechanical properties of the fabric 29 and the shape of the needle's cross section. However, all of these have in common that, in the area of the recesses 5, the fabric 29 and the sewing machine needle 1 are not in mutual contact.

Figure 10A:
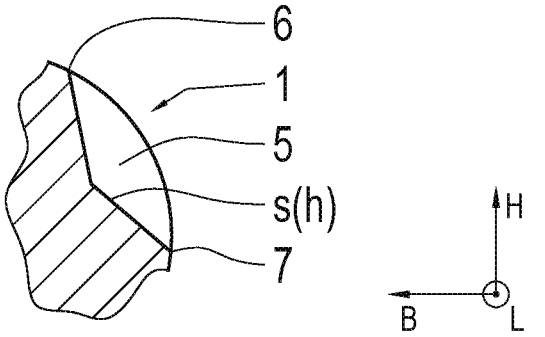
FIG. 10*a* shows a first progression variant of the lateral distance function s(h) in the area of a recess (5).
Figure 10B:
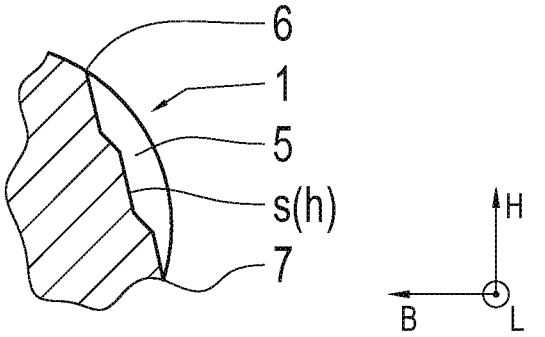
FIG. 10*b* shows a second progression variant of the lateral distance function (h) in the area of a recess (5).
Figure 10C:
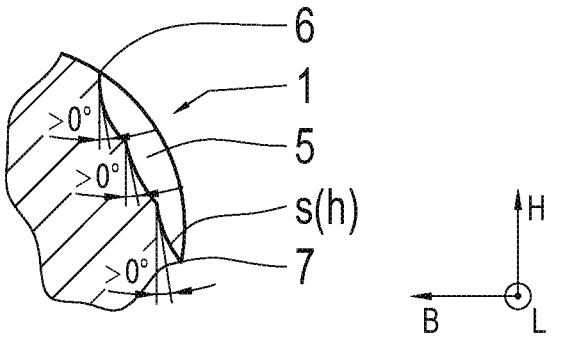
FIG. 10*c* shows a third progression variant of the lateral distance function s(h) in the area of a recess (5).
Figure 10D:
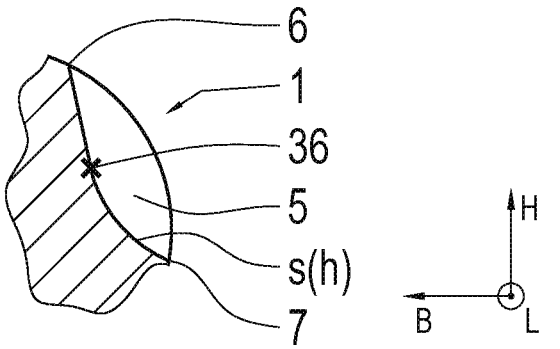
FIG. 10*d* shows a fourth progression variant of the lateral distance function s(h) in the area of a recess (5).

FIGS. 10*a* to 10*d* show four alternative cross-sectional shapes for the recess 5 in a sewing machine needle 1, and the corresponding progression of the lateral distance function s(h). These alternative cross-sectional shapes can be combined advantageously with all possible embodiments of the invention. In the embodiment of FIG. 10*a*, the lateral distance function s(h) between the upper edge 6 and the lower edge 7 of the recess 5 is made up of two straight lines with different gradients, neither of which equals 0. In the embodiment of FIG. 10*b*, the lateral distance function s(h) between the upper edge 6 and the lower edge 7 of the recess 5 is made up of five straight lines. Mutually contiguous straight lines have different gradients, neither of which equals zero. In the embodiment of FIG. 10*c*, the lateral distance function s(h) between the upper edge 6 and the lower edge 7 of the recess 5 is made up of three circular arcs. FIG. 10*d* shows an embodiment having a lateral distance function s(h) made up of a circular arc and a straight line that adjoins this arc in the positive elevational direction H. The transition point 36 between the straight line and the arc is depicted in the drawing: the circular arc commences at the lower edge 7 in the positive elevational direction H and ends at a transition point 36. At this transition point 36, the straight line adjoins the circular arc tangentially, continues in the positive elevational direction H and ends at the upper edge 6.

List of reference numerals

| | |
|---|---|
| 1 | Sewing machine needle |
| 2 | Blade |
| 3 | Needle eye |
| 4 | Thread groove |
| 5 | Recess |
| 6 | Upper edge of recess (5) |
| 7 | Lower edge of recess (5) |
| 8 | Needle blank |
| 9 | Side wall of needle eye (3) |
| 10 | Blade height |
| 11 | Height of recess (5) |
| 12 | Axis of needle eye (3) |
| 13 | Surface of sewing machine needle (1) |
| 14 | Lead-in tangent |
| 15 | Lead-in angle |
| 16 | Scarf |
| 17 | Longitudinal axis |
| 18 | Clamping portion |
| 19 | Transition portion |
| 20 | Tapering portion |
| 21 | Needle point |
| 22 | Principal blade portion |
| 23 | Blade portion |
| 24 | Scarf portion |
| 25 | Shank |
| 26 | Overlap length |
| 27 | Length of scarf (16) |
| 28 | Needle hole |
| 29 | Fabric |
| 30 | Needle blank 8 with triangular cross section |
| 31 | Needle blank 8 with triangular cross section and rounded corners |
| 32 | Needle blank 8 with round cross section |
| 33 | Needle blank 8 with oval cross section |
| 34 | Needle blank 8 with trapezoidal cross section |
| 35 | Needle blank 8 with a cross-sectional shape consisting of two circular arcs and two straight lines |
| 36 | Transition point |
| 37 | Uniformly shaped section of recess (5) |
| B | Lateral direction |
| L | Longitudinal direction |
| H | Elevational direction |
| h | Height coordinate |
| s | Lateral distance |
| s(h) | Lateral distance function dependent on height coordinate (h) |
| O | Upper edge distance |
| U | Lower edge distance |
| $h_O$ | Height coordinate at the level of the upper edge 6 |
| $h_U$ | Height coordinate at the level of the lower edge 7 |

The invention claimed is:

1. A sewing machine needle (1), comprising:

a blade (2) which extends in a longitudinal direction (L), a needle eye (3) which extends completely through the sewing machine needle (1) in an elevational direction (H), the elevational direction (H) being orthogonal to the longitudinal direction (L), a scarf portion (24) of the blade (2) extending along the longitudinal direction (L), the scarf portion (24) comprising a scarf (16);

at least one recess (5) formed in the blade configured to reduce friction between the blade (2) and a fabric, wherein the at least one recess (5) extends outside of the scarf portion (2) in the longitudinal direction (L) and which reduces a reach of the blade (2) in a lateral direction (B), the lateral direction (B) being orthogonal to the elevational (H) and the longitudinal (L) directions, wherein the at least one recess (5) has an upper edge (6) and a lower edge (7), at which the at least one recess (5) ends in the elevational direction (H), wherein the at least one recess (5) has, at least at one position along its length in the longitudinal direction (L), a height (11) which corresponds to at least 30% of a height (10) of the blade (2) at the at least one position, and wherein an upper edge distance (O), which corresponds to a distance in the lateral direction (B) between the upper edge (6) of the at least one recess (5) and a position of an axis (12) of the needle eye (3) in the lateral direction (B), differs from a lower edge distance (U), which corresponds to a distance in the lateral direction (B) between the lower edge (7) of the at least one recess (5) and the position of the axis (12) of the needle eye (3) in the lateral direction (B).

2. The sewing machine needle (1) according to claim 1, wherein the at least one recess (5) has a uniformly shaped section (37), which makes up at least 10% of an entire reach of the at least one recess (5) in the longitudinal direction (L), and the at least one recess (5) has at every position along the uniformly shaped section (37), a height (11) which corresponds to at least 30% of the height (10) of the blade (2).

3. The sewing machine needle (1) according to claim 1, wherein the upper edge distance (O) is smaller than the lower edge distance (U).

4. The sewing machine needle (1) according to claim 1, wherein the at least one recess (5) and the scarf (16) at least partially overlap in the longitudinal direction (L).

5. The sewing machine needle (1) according to claim 1, wherein at least at one position along the length of the at least one recess (5) in the longitudinal direction (L), a distance in the elevational direction (H) between the upper edge (6) and a highest point of the blade (2) in the elevational direction (H) is a maximum of 35% of the blade height (10).

6. The sewing machine needle (1) according to claim 1, wherein a distance in the lateral direction (B) between a surface (13) of the sewing machine needle (1) and the axis (12) of the needle eye (3) is described by a lateral distance function (s (h)) wherein the lateral distance function (s (h)) is dependent on a height coordinate (h) and decreases monotonically, with increasing height over at least 90% of an elevational reach of the recess (5).

7. The sewing machine needle (1) according to claim 1, wherein the at least one recess (5) is spaced in the lateral direction (B) at every point therealong from a position of the axis (12) of the needle eye (3).

8. The sewing machine needle (1) according to claim 1, wherein a lead-in tangent (14) to the at least one recess (5) at the upper edge (6) encloses a lead-in angle (15) of 5° to 70° with the elevational direction (H).

9. The sewing machine needle (1) according to claim 1, wherein at least one thread groove (4) extends in the longitudinal direction (L) and follows on from the needle eye (3) in a negative longitudinal direction (L) and constitutes a depression in the elevational direction (H).

10. The sewing machine needle (1) according to claim 1, wherein at least at one point along the length of the at least one recess (5) in the longitudinal direction (L), in an area between the lower edge (7) and the upper edge (6), in a plane defined by the elevational (H) and lateral (B) directions, a surface (13) of the sewing machine needle (1) is shaped as a circular arc with a constant radius, and a center of the circular arc lies outside a cross-sectional area of the sewing machine needle (1) in the plane defined by the elevational (H) and lateral (B) directions.

11. The sewing machine needle (1) according to claim 6, wherein at least at one point along the length of the at least one recess (5) in the longitudinal direction (L), the recess height (11), which corresponds to the distance between the upper edge (6) and the lower edge (7) in the elevational direction (H), is 60% to 170% of a maximum of the lateral distance function (s (h)).

12. The sewing machine needle (1) according to claim 6, wherein at least at one point along the length of the at least one recess (5) in the longitudinal direction (L), the upper edge distance (O) is 10% to 60% of a maximum of the lateral distance function (s(h)).

13. The sewing machine needle (1) according to claim 6, wherein at least at one point along the length of the at least one recess (5) in the longitudinal direction (L), the lower edge distance (U) is 50% to 100% of a maximum of the lateral distance function (s (h)).

14. A method for production of a sewing machine needle (1), comprising:

producing the sewing machine needle using a tool movement exclusively in an elevational direction (H) and/or a longitudinal direction (L), the sewing machine needle comprising:

a blade extending in the longitudinal direction (L), a needle eye (3) that extends through the sewing machine needle (1) in an elevational direction (H), which is orthogonal to the longitudinal direction (L), a scarf portion (24) of the blade extending along the longitudinal direction (L), the scarf portion (24) comprising a scarf (16);

at least one recess (5) formed in the blade configured to reduce friction between the blade (2) and a fabric, wherein the at least one recess (5) extends outside of the scarf portion (2) in the longitudinal direction (L) and, which is delimited in the elevational direction (H) by an upper edge (6) and a lower edge (7), wherein an upper edge distance (O) corresponding to a distance in a lateral direction (B) between the upper edge (6) of the at least one recess (5) and a position of an axis (12) of the needle eye (3) in the lateral direction (B), differs from a lower edge distance (U), the lower edge distance (U) corresponding to a distance in the lateral direction (B) between the lower edge (7) of the at least one recess (5) and the position of the axis (12) of the needle eye (3) in the lateral direction (B).

15. The method for production of a sewing machine needle according to claim 14, further comprising producing the at least one recess (5) by a separating process-or by a forming process.

* * * * *